US008425323B2

(12) United States Patent
Fiden et al.

(10) Patent No.: US 8,425,323 B2
(45) Date of Patent: Apr. 23, 2013

(54) WAGERING GAME WITH ASSET TRADING

(75) Inventors: Daniel P. Fiden, Chicago, IL (US); Lisa M. Helfer, Chicago, IL (US); Matthew J. Ward, Northbrook, IL (US)

(73) Assignee: WMS Gaming Inc., Waukegan, IL (US)

( * ) Notice: Subject to any disclaimer, the term of this patent is extended or adjusted under 35 U.S.C. 154(b) by 1319 days.

(21) Appl. No.: 11/988,853

(22) PCT Filed: Jun. 30, 2005

(86) PCT No.: PCT/US2005/023822

§ 371 (c)(1),
(2), (4) Date: Jan. 10, 2008

(87) PCT Pub. No.: WO2006/005073

PCT Pub. Date: Jan. 12, 2006

(65) Prior Publication Data

US 2010/0130276 A1 May 27, 2010

Related U.S. Application Data

(60) Provisional application No. 60/584,714, filed on Jun. 30, 2004.

(51) Int. Cl.
*A63F 9/24* (2006.01)

(52) U.S. Cl.
USPC ..... 463/42; 463/16; 463/20

(58) Field of Classification Search ..... 463/16, 463/42

See application file for complete search history.

(56) References Cited

U.S. PATENT DOCUMENTS

| | | | | |
|---|---|---|---|---|
| 4,752,068 | A | 6/1988 | Endo | 463/15 |
| 5,575,474 | A | 11/1996 | Rossides | 463/26 |
| 5,609,525 | A | 3/1997 | Ohno et al. | 463/43 |
| 5,833,537 | A | 11/1998 | Barrie | 463/21 |
| 5,957,775 | A | 9/1999 | Cherry | 463/16 |
| 6,004,211 | A | 12/1999 | Brenner et al. | 463/40 |
| 6,012,045 | A | 1/2000 | Barzillai et al. | |
| 6,012,983 | A | 1/2000 | Walker et al. | 463/20 |

(Continued)

FOREIGN PATENT DOCUMENTS

| | | |
|---|---|---|
| WO | WO 9929381 | 6/1999 |
| WO | WO 2005082480 A1 | 9/2005 |

(Continued)

OTHER PUBLICATIONS

International Search Report and Written Opinion—PCT/US05/23822, dated Mar. 14, 2006 (10 pages).

*Primary Examiner* — Melba Bumgarner
*Assistant Examiner* — Anh Vo V Nguyen
(74) *Attorney, Agent, or Firm* — Nixon Peabody LLP

(57) ABSTRACT

Method and system are disclosed for operating a wagering game terminal where players are allowed to transfer game assets that they may have accumulated to other players. The game assets may be transferred as part of an on-line auction won by one of the other players, as a gift to a preselected player, or as part of a trade with a preselected player. Neither the transferring player nor the receiving player is required to be present at a wagering game terminal at the time of the transfer. The transfer may be an anonymous transfer or it may be an identity-based transfer. For identity-based transfers, a predefined list of selected players may be used to facilitate the transfers.

11 Claims, 9 Drawing Sheets

U.S. PATENT DOCUMENTS

| | | | | |
|---|---|---|---|---|
| 6,015,344 | A | 1/2000 | Kelly et al. | 463/16 |
| 6,068,553 | A | 5/2000 | Parker | 463/27 |
| 6,077,163 | A | 6/2000 | Walker et al. | 463/26 |
| 6,113,098 | A | 9/2000 | Adams | 273/143 R |
| 6,165,071 | A | 12/2000 | Weiss | 463/24 |
| 6,234,896 | B1 | 5/2001 | Walker et al. | 463/16 |
| 6,254,481 | B1 | 7/2001 | Jaffe | 463/20 |
| 6,273,820 | B1 | 8/2001 | Haste, III | 463/40 |
| 6,302,790 | B1 | 10/2001 | Brossard | 463/20 |
| 6,311,976 | B1 | 11/2001 | Yoseloff et al. | 273/138 |
| 6,319,127 | B1 | 11/2001 | Walker et al. | 463/26 |
| 6,364,765 | B1 | 4/2002 | Walker et al. | 463/16 |
| 6,364,766 | B1 | 4/2002 | Anderson et al. | 463/16 |
| 6,365,765 | B1 | 4/2002 | Baldwin et al. | 556/440 |
| 6,386,975 | B1 * | 5/2002 | Peterson | 463/16 |
| 6,431,983 | B2 | 8/2002 | Acres | 463/25 |
| 6,443,841 | B1 * | 9/2002 | Rossides | 463/25 |
| 6,506,117 | B2 | 1/2003 | DeMar et al. | 463/20 |
| 6,506,118 | B1 | 1/2003 | Baerlocher et al. | 463/25 |
| 6,663,489 | B2 | 12/2003 | Baerlocher | 463/20 |
| 6,709,333 | B1 * | 3/2004 | Bradford et al. | 463/29 |
| 6,722,981 | B2 | 4/2004 | Kaminkow et al. | 463/20 |
| 6,722,985 | B2 | 4/2004 | Criss-Puszkiewicz et al. | 463/29 |
| 6,745,236 | B1 | 6/2004 | Hawkins et al. | 709/203 |
| 6,758,757 | B2 | 7/2004 | Luciano, Jr. et al. | 463/43 |
| 6,776,713 | B2 | 8/2004 | Gauselmann | 463/16 |
| 6,780,111 | B2 | 8/2004 | Cannon et al. | 463/25 |
| 6,800,027 | B2 | 10/2004 | Giobbi et al. | 463/24 |
| 6,811,486 | B1 | 11/2004 | Luciano, Jr. | 463/24 |
| 6,853,973 | B2 | 2/2005 | Mathews et al. | |
| 6,923,721 | B2 | 8/2005 | Luciano et al. | 463/24 |
| 7,182,690 | B2 | 2/2007 | Giobbi et al. | 463/24 |
| 7,424,617 | B2 * | 9/2008 | Boyd et al. | 713/176 |
| 2001/0024971 | A1 | 9/2001 | Brossard | 463/30 |
| 2002/0028708 | A1 | 3/2002 | Busch et al. | |
| 2002/0039919 | A1 | 4/2002 | Joshi et al. | 463/20 |
| 2002/0077173 | A1 | 6/2002 | Luciano, Jr. et al. | 463/23 |
| 2002/0077174 | A1 | 6/2002 | Luciano et al. | 463/25 |
| 2002/0093136 | A1 | 7/2002 | Moody | 273/139 |
| 2002/0094871 | A1 | 7/2002 | Luciano, Jr. et al. | 463/43 |
| 2002/0107065 | A1 | 8/2002 | Rowe | 463/20 |
| 2002/0142825 | A1 * | 10/2002 | Lark et al. | 463/16 |
| 2002/0151349 | A1 | 10/2002 | Joshi | 463/20 |
| 2002/0174020 | A1 | 11/2002 | Grey et al. | |
| 2002/0196342 | A1 | 12/2002 | Walker et al. | 348/157 |
| 2003/0013515 | A1 | 1/2003 | Rowe et al. | 463/25 |
| 2003/0013531 | A1 | 1/2003 | Rowe et al. | 463/42 |
| 2003/0036422 | A1 | 2/2003 | Baerlocher et al. | 463/20 |
| 2003/0036427 | A1 | 2/2003 | Brandstetter et al. | 463/29 |
| 2003/0064794 | A1 | 4/2003 | Mead et al. | 463/25 |
| 2003/0078101 | A1 | 4/2003 | Schneider et al. | 463/42 |
| 2003/0100362 | A1 | 5/2003 | Horniak et al. | 463/25 |
| 2003/0104857 | A1 | 6/2003 | Jenkins | |
| 2003/0106769 | A1 | 6/2003 | Weiss | 463/25 |
| 2003/0114219 | A1 | 6/2003 | McClintic | 463/25 |
| 2003/0119579 | A1 | 6/2003 | Walker et al. | 463/21 |
| 2003/0157979 | A1 | 8/2003 | Cannon et al. | 463/16 |
| 2003/0195024 | A1 | 10/2003 | Slattery | 463/9 |
| 2003/0211881 | A1 | 11/2003 | Walker et al. | 463/20 |
| 2004/0039695 | A1 | 2/2004 | Rowe | |
| 2004/0053680 | A1 | 3/2004 | Schultz | 463/20 |
| 2004/0110554 | A1 | 6/2004 | Bromfield | |
| 2004/0142742 | A1 | 7/2004 | Schneider et al. | 463/25 |
| 2004/0209662 | A1 | 10/2004 | Wadleigh | 463/16 |
| 2004/0242297 | A1 * | 12/2004 | Walker et al. | 463/13 |
| 2004/0243504 | A1 | 12/2004 | Asher et al. | |
| 2005/0003886 | A1 | 1/2005 | Englman et al. | 463/25 |
| 2005/0159207 | A1 | 7/2005 | Thomas | 463/20 |
| 2006/0068893 | A1 | 3/2006 | Jaffe et al. | 463/20 |
| 2006/0079316 | A1 | 4/2006 | Flemming et al. | 463/25 |
| 2006/0079317 | A1 | 4/2006 | Flemming et al. | 463/20 |
| 2006/0084495 | A1 | 4/2006 | Jaffe et al. | 463/20 |
| 2006/0084496 | A1 | 4/2006 | Jaffe et al. | 463/20 |
| 2006/0089194 | A1 | 4/2006 | Joshi et al. | 463/25 |
| 2006/0100006 | A1 | 5/2006 | Mitchell et al. | |
| 2006/0160620 | A1 * | 7/2006 | Matthews et al. | 463/42 |
| 2006/0165060 | A1 | 7/2006 | Dua | |
| 2007/0202951 | A1 * | 8/2007 | Bogosian et al. | 463/42 |
| 2007/0254734 | A1 | 11/2007 | Gilmore et al. | 463/20 |
| 2007/0259706 | A1 | 11/2007 | Anderson et al. | 463/16 |
| 2007/0259713 | A1 | 11/2007 | Fiden et al. | 463/25 |
| 2007/0265060 | A1 | 11/2007 | Hornik et al. | 463/20 |
| 2007/0298856 | A1 | 12/2007 | Gilmore et al. | 463/16 |
| 2008/0113770 | A1 | 5/2008 | Gelber et al. | 463/25 |

FOREIGN PATENT DOCUMENTS

| | | | |
|---|---|---|---|
| WO | WO 2006002241 | A2 | 1/2006 |
| WO | WO 2006004831 | A2 | 1/2006 |
| WO | WO 2006004832 | A2 | 1/2006 |
| WO | WO 2006005073 | A2 | 1/2006 |
| WO | WO 2006017036 | A1 | 2/2006 |
| WO | WO 2006017067 | A1 | 2/2006 |
| WO | WO 2006017068 | A1 | 2/2006 |
| WO | WO 2006020811 | A2 | 2/2006 |
| WO | WO 2006026250 | A2 | 3/2006 |
| WO | WO 2006044252 | A2 | 4/2006 |
| WO | WO 2007/103054 | A2 | 9/2007 |
| WO | WO 2008/048634 | A2 | 4/2008 |

* cited by examiner

WAGERING GAME WITH ASSET TRADING

CROSS-REFERENCE TO RELATED APPLICATIONS

This application claims priority to both PCT Application Serial No. PCT/US2005/023822, filed on Jun. 30, 2005, and U.S. Provisional Patent Application Ser. No. 60/584,714, filed on Jun. 30, 2004, both of which are incorporated by reference in their entirety.

FIELD OF THE INVENTION

The present invention relates generally to wagering game terminals and, more particularly, to a method and system of operating a wagering game terminal where players are allowed to transfer their game assets.

BACKGROUND OF THE INVENTION

Wagering game terminals, such as slot machines, video poker machines, and the like, have been a cornerstone of the gaming industry for several years. The popularity of such wagering game terminals among players generally depends on the perceived likelihood of winning money at the terminal and the intrinsic entertainment value of the terminal relative to other available gaming options. Where the available gaming options include a number of competing terminals and the expectation of winning each terminal is roughly the same (or believed to be the same), players are likely to be attracted to the more entertaining and exciting of the terminals.

Consequently, wagering game terminal operators strive to employ the most entertaining and exciting terminals available because such terminals attract frequent play and, hence, increase profitability for the operators. Thus, in the highly competitive wagering game terminal industry, there is a continuing need to develop new types of games, or improvements to existing games, that will enhance the entertainment value and excitement associated with the games.

One concept that has been successfully employed in existing wagering game terminals to enhance player entertainment is the use of progressive games. In the gaming industry, a "progressive" game involves collecting coin-in data from participating gaming device(s) (e.g., slot machines), contributing a percentage of that coin-in data to a progressive jackpot amount, and awarding that jackpot amount to a player upon the occurrence of a certain jackpot-won event. A jackpot-won event typically occurs when a "progressive winning position" is achieved at a participating gaming device. If the gaming device is a slot machine, a progressive winning position may, for example, correspond to alignment of progressive jackpot reel symbols along a certain payline. The initial progressive jackpot is a predetermined minimum amount. That jackpot amount, however, progressively increases as players continue to play the gaming machine without winning the jackpot. Further, when several gaming machines are linked together such that several players at several gaming machines compete for the same jackpot, the jackpot progressively increases at a much faster rate, which leads to further player excitement.

Another concept that has been employed is that of a secondary or "bonus" game which may be played in conjunction with a "basic" game. The bonus game may include any type of game, either similar to or entirely different from the basic game, and is initiated by the occurrence of certain pre-selected events or outcomes of the basic game. Such a bonus game has been found to produce a significantly higher level of player excitement than the basic game alone because it provides an additional chance to play, which increases the player's overall expectation of winning.

In current wagering game terminals, in general, once a player leaves a game, there is little incentive for the player to return to the game at a later time. Typically, upon termination of play, the player is immediately awarded the balance of any credits, but also loses any unused or unredeemed game assets that he may have accumulated. For example, some bonus games involve the player collecting game assets until a certain number or combination of assets is accumulated, at which point the player wins an award. However, if the player leaves the game prior to winning the award, he loses all of his game assets and is forced to start from the beginning the next time he plays. There is no way for the player to transfer the game assets to another player, for example, in exchange for monetary value. Thus, with all of his game assets gone, there is little incentive for the player to return to the game at a later time.

Thus, in general, there is a need for wagering game terminals that allow players who accumulate game assets to retain those game assets, or at least the benefit of those game assets. In particular, there is a need for wagering game terminals that allow players who accumulate game assets to be able to transfer the game assets to other players.

SUMMARY OF THE INVENTION

The present invention is directed to a method and system for operating a wagering game terminal where players are allowed to transfer game assets that they may have accumulated to other players. The game assets may be transferred as part of an on-line auction won by one of the other players, as a gift to a preselected player, or as part of a trade with a preselected player. Neither the transferring player nor the receiving player is required to be present at a wagering game terminal at the time of the transfer. The transfer may be an anonymous transfer or it may be an identity-based transfer. For identity-based transfers, a predefined list of selected players may be used to facilitate the transfers.

In general, in one aspect, the invention is directed to a method of reallocating game assets between wagering game terminals on a network. The method comprises sending a notification message from a first wagering game terminal to a second wagering game terminal notifying the second wagering game terminal that the first wagering game terminal has a game asset available to be transferred. The method further comprises transferring the game asset from the first wagering game terminal to the second wagering game terminal upon occurrence of a predetermined event.

In general, in another aspect, the invention is directed to a system for reallocating game assets between wagering game terminals. The system comprises a first wagering game terminal having a game asset available to be transferred and a second wagering game terminal connected to the first wagering game terminal over a network. The first wagering game terminal is configured to transfer the game asset to the second terminal upon occurrence of a predetermined event.

In general, in yet another aspect, the invention is directed to a method of operating a wagering game terminal having a game-asset transfer capability, the wagering game terminal connected to a network of wagering game terminals. The method comprises displaying a randomly selected outcome from a wagering game on the wagering game terminal, the randomly selected outcome being selected from a plurality of outcomes in response to receiving a wager input, the plurality of outcomes including at least one special event outcome. In response to the randomly selected outcome being the at least one special event outcome, the method further comprises allowing a player to either play a special event game resulting from the at least one special event outcome or transfer the special event game to another wagering game terminal connected to the network of wagering game terminals.

In general, in still another aspect, the invention is directed to a wagering game terminal with game asset transfer capability. The wagering game terminal comprises a display configured to display a randomly selected outcome from a wagering game, the randomly selected outcome being selected from a plurality of outcomes in response to receiving a wager input, the plurality of outcomes including at least one special event outcome. The wagering game terminal further comprises a network interface unit for connecting the wagering game terminal to a network of wagering game terminals. In response to the randomly selected outcome being the at least one special event outcome, the wagering game terminal allowing a player to either play a special event game resulting from the at least one special event outcome or transfer the special event game to another wagering game terminal connected to the network of wagering game terminals.

In general, in yet another aspect, the invention is directed to a method of transporting game assets between wagering game terminals. The method comprises the steps of collecting information regarding the game assets in a first wagering game terminal, and storing the information regarding the game assets along with an identifier for the information. The method further comprises the step of transferring the information regarding the game assets from the first wagering game terminal to a second wagering game terminal.

The above summary of the present invention is not intended to represent each embodiment or every aspect of the present invention. The detailed description and drawings will describe many of the embodiments and aspects of the present invention.

BRIEF DESCRIPTION OF THE DRAWINGS

The foregoing and other advantages of the invention will become apparent upon reading the following detailed description and upon reference to the drawings.

Figure 1:
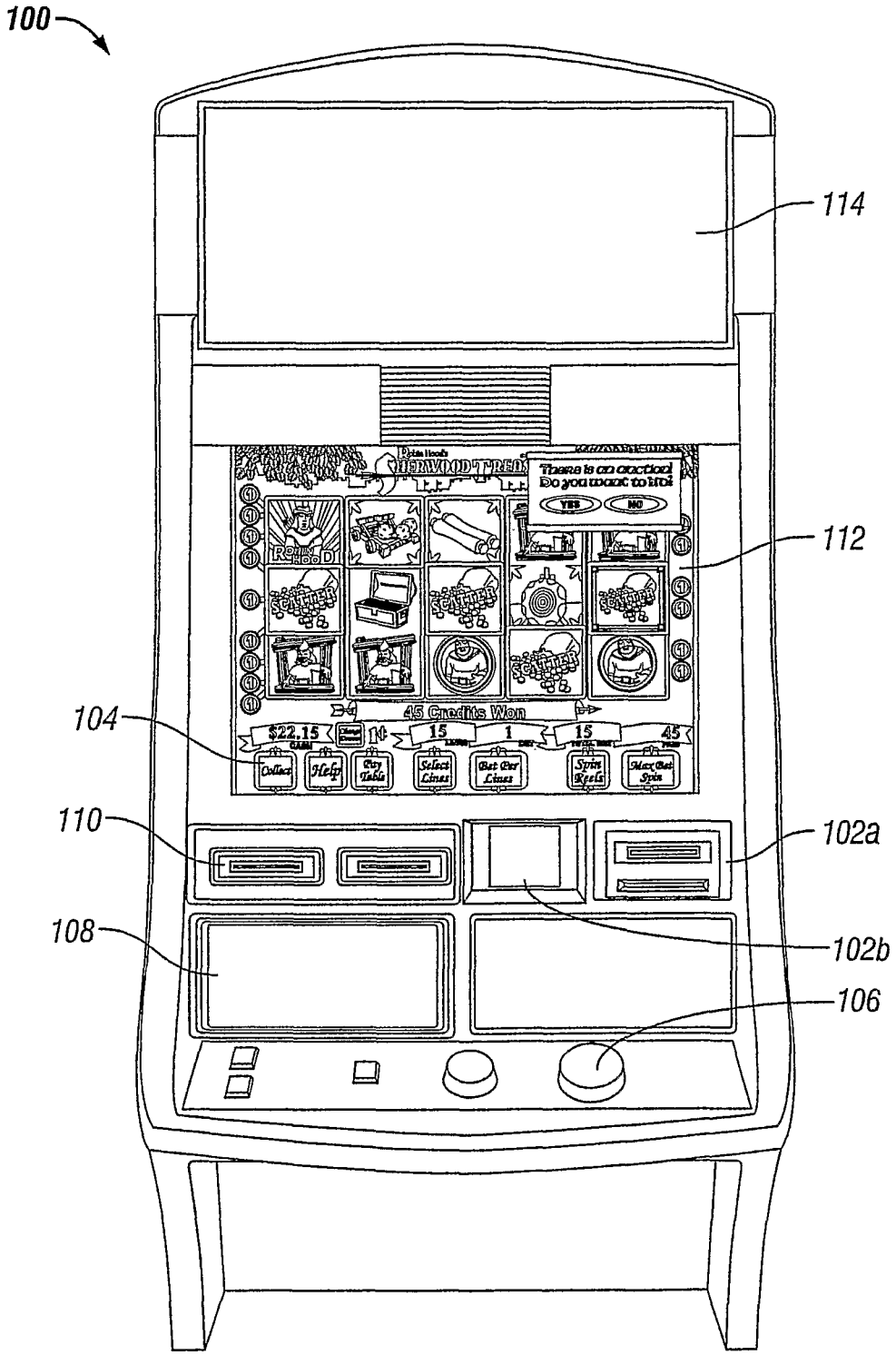
FIG. 1 illustrates a wagering game terminal having a transferable bonus game according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

As mentioned above, embodiments of the invention provide a method and system for operating a wagering game terminal where players are allowed to transfer game assets they may have won to other players at other wagering game terminals. Such an arrangement allows the players to retain the benefits of their game assets should they decide not to use them or are unable to use them.

FIG. 1 shows a perspective view of an exemplary wagering game terminal 100 according to embodiments of the invention. The wagering game terminal 100 may be operated as a stand-alone terminal, or it may be connected to a network of wagering game terminals. Further, the wagering game terminal 100 may be any type of wagering game terminal and may have varying structures and methods of operation. For example, the wagering game terminal 100 may be a mechanical wagering game terminal configured to play mechanical slots, or it may be an electromechanical or electrical wagering game terminal configured to play a video casino game, such as blackjack, slots, keno, poker, etc. In the example shown, the wagering game terminal 100 is a video slot machine.

As shown, the wagering game terminal 100 includes input devices, such as a wager acceptor 102 (shown as a card wager acceptor 102*a* and a cash wager accepter 102*b*), a touch screen 104, a push-button panel 106, a payout mechanism 108, and an information reader 110. The wagering game terminal 100 further includes a main display 112 for displaying information about the basic wagering game and, in some embodiments, a secondary display 114 for displaying a pay table and/or game-related information or other entertainment features. While these typical components found in the wagering game terminal 100 are described briefly below, it should be understood that numerous other elements may exist and may be used in any number of combinations to create variation of the wagering game terminal 100.

The wager acceptors 102*a* and 102*b* may be provided in many forms, individually or in combination. For example, the cash wager acceptor 102*a* may include a coin slot acceptor or a note acceptor to input value to the wagering game terminal 100. The card wager acceptor 102*b* may include a card-reading device for reading a card that has a recorded monetary value with which it is associated. The card wager acceptor 102*b* may also receive a card that authorizes access to a central account that can transfer money to the wagering game terminal 100.

The payout mechanism 108 performs the reverse function of the wager acceptors 102*a* and 102*b*. For example, the payout mechanism 108 may include a coin dispenser or a note dispenser to dispense money or tokens from the wagering game terminal 100. The payout mechanism 108 may also be adapted to receive a card that authorizes the wagering game terminal 100 to transfer credits from the wagering game terminal 100 to a central account.

The push button panel 106 is typically offered, in addition to the touch screen 104, to provide players with an option on making their game selections. Alternatively, the push button panel 106 may facilitate player input needed for certain aspects of operating the game, while the touch screen 104 facilitates player input needed for other aspects of operating the game.

The outcome of the basic wagering game is displayed to the player on the main display 112. The main display 112 may take a variety of forms, including a cathode ray tube (CRT), a high resolution LCD, a plasma display, LED, or any other type of video display suitable for use in the wagering game terminal 100. As shown here, the main display 112 also includes the touch screen 104 overlaying the entire display (or a portion thereof) to allow players to make game-related selections. Alternatively, the wagering game terminal 100 may include a number of mechanical reels that display the game outcome.

In some embodiments, the information reader 110 is a card reader that allows for identification of a player by reading a card with information indicating they player's identity. Currently, identification is used by casinos for rewarding certain players with complimentary services or special offers. For example, a player may be enrolled in the gaming establishment's players' club and may be awarded certain complimentary services as that player collects points in his or her player-tracking account. The player inserts his or her card into the player-identification card reader 110, which allows the casino's computers to register that player's wagering at the wagering game terminal 100. Then, the wagering game terminal 100 may use the secondary display 114 for providing the player with information about his or her account or other player-specific information. Also, in some embodiments, the information reader 110 may be used to restore assets that the player achieved during a previous game session and had saved.

Figure 2:
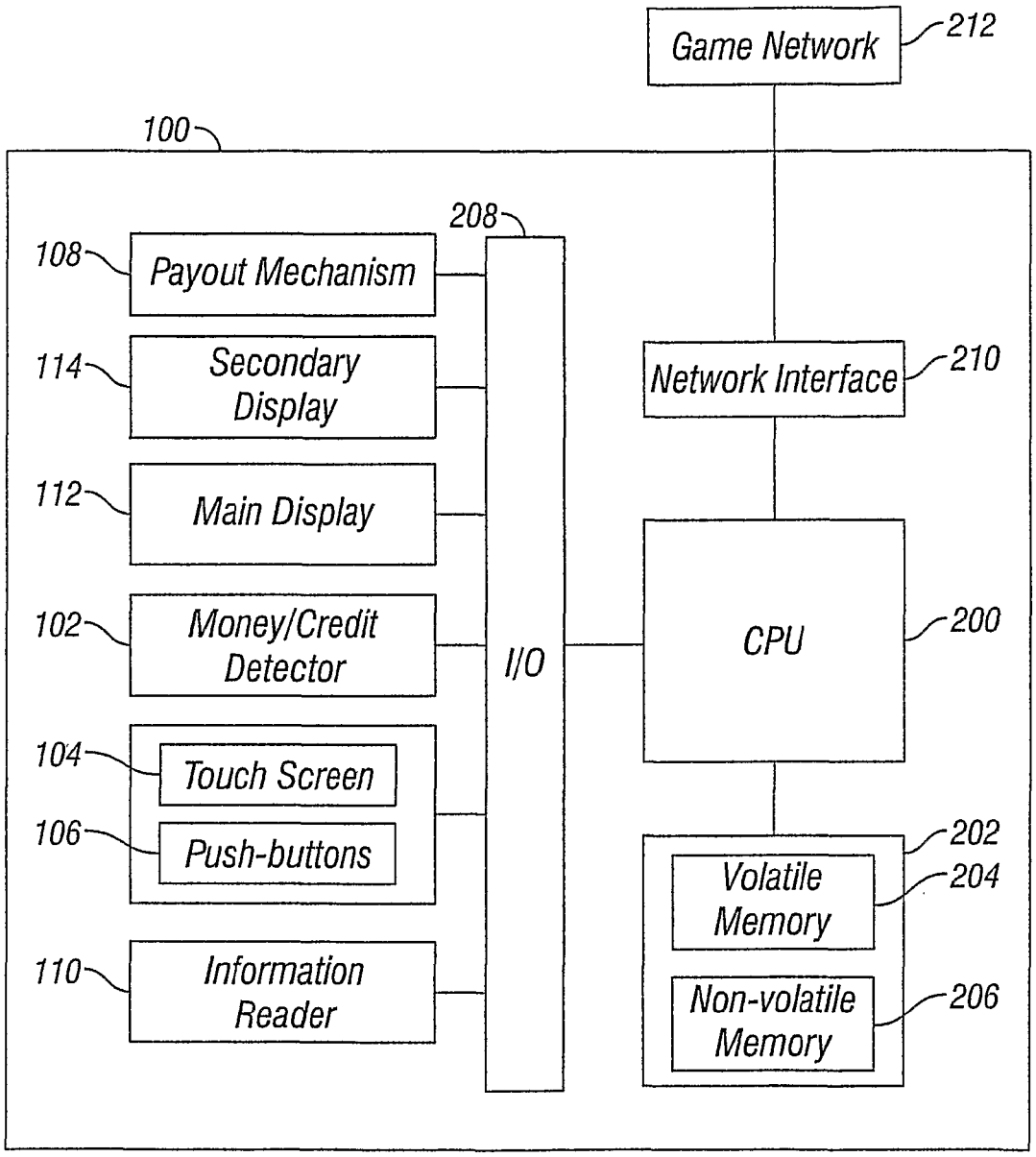
FIG. 2 illustrates the wagering game terminal of FIG. 1 in more detail.

As shown in FIG. 2, the various components of the wagering game terminal 100 are controlled by a central processing unit (CPU) 200, such as one or more microprocessors or microcontrollers. To provide the gaming functions, the CPU 200 executes a game program that generates a randomly selected game outcome. The CPU 200 is also coupled to or includes a local memory 202. The local memory 202 may be in the form of one or more volatile memories 204 (e.g., a random-access memory (RAM)) and one or more non-volatile memories 206 (e.g., an EEPROM).

Communication between the peripheral components of the wagering game terminal 100 and the CPU 200 is controlled by the CPU 200 through input/output (I/O) circuits 208. The CPU 200 also communicates with external systems via a network interface unit 210. Although the I/O circuit 208 and network interface unit 210 are shown here as individual components, it should be appreciated that both of these units may include a number of different types of components.

Figure 3:
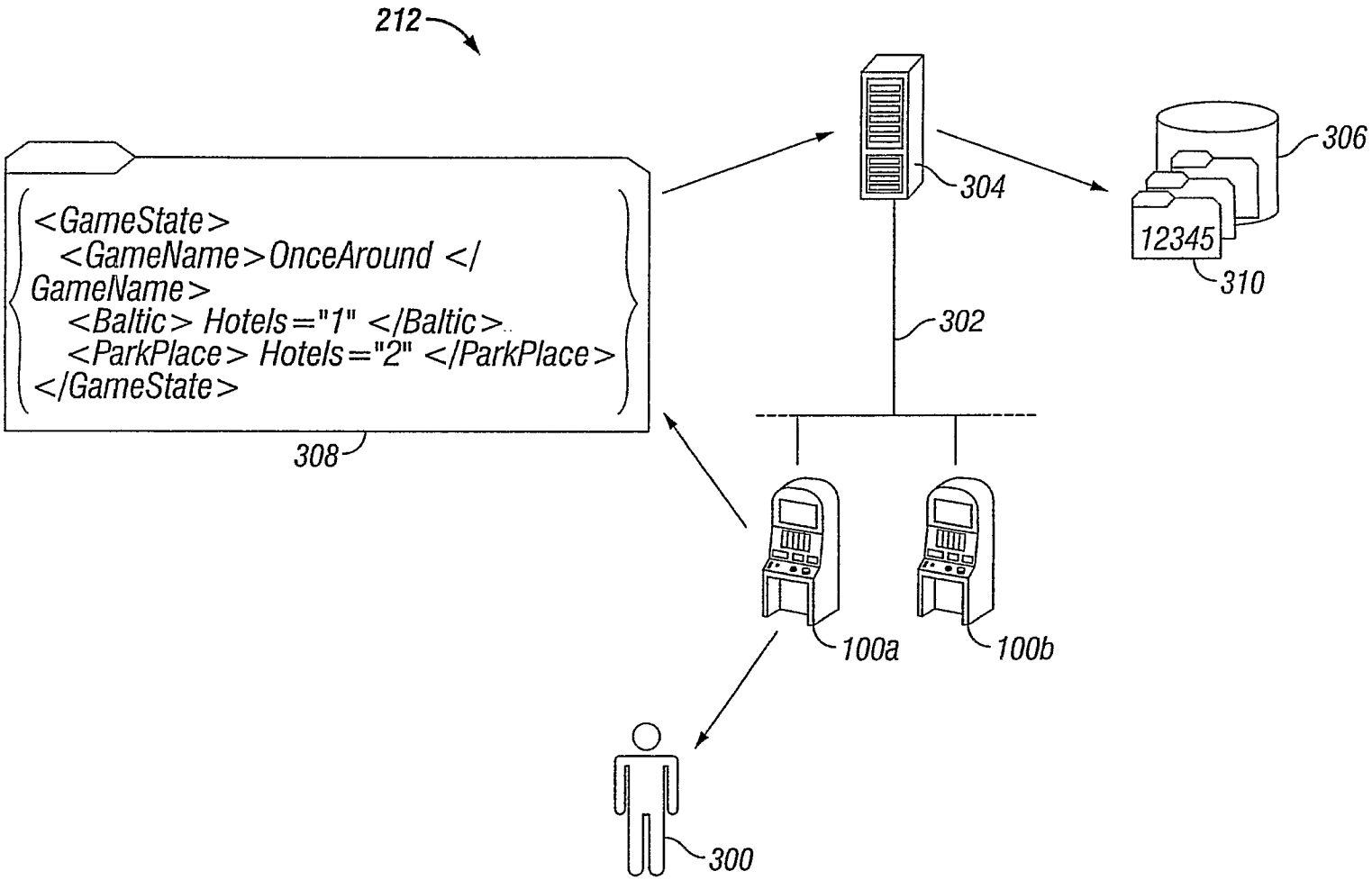
FIG. 3 illustrates a network to which the wagering game terminal of FIG. 1 may be connected.

As alluded to above, the wagering game terminal 100 may be a stand-alone terminal, or it may be part of a network 212 that connects multiple wagering game terminals 100 together. FIG. 3 illustrates the network 212 in more detail, including a plurality of wagering game terminals 100*a* and 100*b* connected via an Ethernet-TCP/IP connection 302 to a network server 304. The wagering game terminals 100*a* and 100*b* are similar to the wagering game terminal 100 (FIG. 1) in that they have many of the same features and components. In addition, one or more functions of the CPU 200 (FIG. 2) in the terminals 100*a* and 100*b* may reside on the network server 304 instead of, or in addition to, the wagering game terminal 100. The network server 304 may then conduct the basic and/or bonus games (or portions thereof) in place of the CPU 200 for each of the wagering game terminals 100*a* and 100*b* connected to the network 212, including providing the input data and information needed to operate the basic and/or bonus games.

The network server 304 may also control the progressive jackpots mentioned previously that are contributed to by all or some of the wagering game terminals 100*a* and 100*b* in the network 212 (e.g., terminal-level jackpots that only each terminal 100*a* or 100*b* contributes to, bank-level jackpots that are contributed to by all of the terminals 100*a* and 100*b* in a particular bank, and wide-area jackpots that are contributed to by a larger number of terminals 100*a* and 100*b*, such as multiple banks).

In addition, in accordance with embodiments of the invention, the network 212 allows players playing at one of the wagering game terminals 100*a* or 100*b* to store game assets that they may have accumulated for subsequent retrieval at a later time. The game assets may be any aspect of a basic and/or bonus game, whether tangible or intangible, that a player may win or accumulate, including, but not limited to, monetary or non-monetary awards, features or characteristics of a game (e.g., a wild symbol, free spins), features or characteristics of a player (e.g., extra lives, intelligence, skills, equipment), a bonus game, and the like. By allowing the players to retain their game assets when they cash out, the players are given much incentive to return to the wagering game terminals 100*a* and 100*b* at a later time.

In some embodiments, the game assets, including any bonus games, may be retained through a "ticket-in-ticket-out" (TITO) system on the network 212. The TITO system issues each player a ticket when the player departs a wagering game terminal 100*a* or 100*b*, which ticket can be used later to retrieve all the assets that the player has accumulated in the current game. Then, when the player returns to any wagering game terminal 100*a* or 100*b* on the network 212, he may retrieve his game assets by presenting the ticket. An exemplary implementation of a TITO system is described below.

Referring still to FIG. 3, when a player 300 is ready to cash out of any wagering game terminal 100*a* or 100*b* on the network 212, the player 300 may request a ticket for his current game. Upon receiving such as request, the wagering game terminal 100*a* or 100*b* generates a game-specific file 308, which may be a text file, XML file, or other suitable format, that identifies the current wagering game terminal, the current game, the game assets that have been accumulated in the current game, and the like. The game-specific file 308 is then forwarded over the Ethernet-TCP/IP connection 302 to the server 304. The server 304 thereafter creates a game record 310 for the game-specific file 308 in a database 306 connected to the server 304 and generates a unique identifier for the game record 310. The unique identifier preferably is independent of the player's identification such that the player may remain anonymous to the network 212 and the wagering game terminal 100*a* or 100*b*, but it is also possible to use an identity-based identifier. The server 304 then sends the unique identifier back to the wagering game terminal 100*a* or 100*b*. The wagering game terminal 100*a* or 100*b* subsequently issues the player 300 a ticket, which may be a paper ticket or an electronic ticket, containing the unique identifier (e.g., in barcodes). The ticket may be issued through the information reader 110 or any other suitable means commonly used for issuing such tickets.

When the player 300 returns to one of the wagering game terminals 100*a* or 100*b*, he may present his ticket to the information reader 110 to retrieve his accumulated assets. The wagering game terminal 100*a* or 100*b* may be any wagering game terminal on the network 212 and does not have to be the same wagering game terminal that the player 300 played on previously. Upon receiving the ticket, the wagering game terminal 100*a* or 100*b* sends a request to the server 304 to retrieve the game record 310 that corresponds to the unique identifier of the ticket presented. If the server 304 determines that the ticket is valid (i.e., the unique identifier matches an unclaimed game record 310), it retrieves the corresponding game record 310 and sends the information contained therein back to the wagering game terminal 100*a* or 100*b*. The server 304 thereafter either deletes the game record 310 or marks it as "claimed" so that it is not reused. The terminal 100*a* or 100*b* then configures itself according to the game asset information received from the server 304 such that the player retains all of his game assets.

In embodiments where the wagering game terminal 100*a* or 100*b* is a stand-alone terminal that is not connected to the network 212, the game record 310 may be created by the CPU 200 (FIG. 2) and stored in the local memory 202 of the wagering game terminal instead of on the network. Then, when the player 300 returns to the same stand-alone wagering game terminal to present his ticket (e.g., via the information reader 110), the appropriate game record 310 may be retrieved based on the unique identifier on the ticket. The CPU 200 thereafter restores the player's game assets along with any other information (e.g., wagering game terminal, game, etc.) that was stored in the game record 310. This allows the player to keep his game assets even after a particular gaming session ends, thereby increasing player commitment to a game.

In some embodiments, instead of a ticket, the information reader 110 may include a card reader, and the unique identifier provided by the wagering game terminal 100*a* or 100*b* may be stored on a player's personal identification card. Or, the wagering game terminal 100*a* or 100*b* may include a radio frequency identification device (RFID) transceiver or receiver (not shown) such that an RFID transponder held by the player can be used to provide the unique identifier at the wagering game terminal 100*a* or 100*b* without the need to insert a card into the information reader 110. RFID components can be those available from Pacific Northwest National Laboratory (under the United States Department of Energy) of Richland, Wash.

In other embodiments, the information reader 110 may also include a biometric reader, such as a finger, hand, or retina scanner, and the unique identifier may be the scanned biometric information. Additional information regarding biometric scanning, such as fingerprint scanning or hand geometry scanning, is available from International Biometric Group LLC of New York, N.Y. Other biometric identification techniques can be used as well for providing a unique identifier of the player. For example, a microphone can be used in a biometric identification device on the wagering game terminal so that the player can be recognized using a voice recognition system.

Following is one example of a game asset transfer that may take place according to embodiments of the invention. In the example, the player previously concluded a game session and is now returning to begin a subsequent game session. Upon presenting either his ticket or a player identification card to the information reader 110, a welcome screen, such as the exemplary welcome screen 400 shown in FIG. 4, may be displayed on the main display 112 (or the secondary display 114) of the wagering game terminal 100*a* or 100*b* to welcome back players returning players. At this point, the wagering game terminal 100*a* or 100*b* has restored all of the player's game asset to the player. This is shown at least in part by the greeting screen 400, which contains a variety of information from the player's last game session, including the player's current credit balance with the casino along with a listing or graphical representation of any game assets that the player may have accumulated.

A friends list 402 shows which players from a predefined list of players are currently playing on a network wagering game terminal. As other players from the predefined list begin playing on the network wagering game terminals, an appropriate notification message may be automatically sent to the player and the friends list 402 updated. In some embodiments, certain game assets are available only if certain players are playing on a network wagering game terminal. For example, player A and player B may each have half of a certain game asset (e.g., a watermelon) at all times, but they each will have a full game asset only when both players are playing on the network wagering game terminals. That is, when both players are playing on the network wagering game terminals, there is an automatic sharing of each player's half game asset with the other player.

A messaging button 404 allows the player to send electronic messages to, and receive electronic messages from, anyone appearing on the friends list 402. In some embodiments, no electronic messages may be received from, or sent to, players who are not on the friends list 402.

In accordance with embodiments of the invention, an auctions button 406 allows the player to transfer, via an on-line auction, one or more of his accumulated game assets. The details for implementing such an on-line auction are generally well-known to persons having ordinary skill in the art and will therefore not be described here. In addition, although a bonus game is shown here, the invention is not to be limited thereto and any type of game asset that can be accumulated may be transferred.

The bonus game may be one that the player won in a previous game session that has now been restored along with other game assets, or it may be a bonus game won during the current game session. In the latter case, when the player wins a bonus game as part of his basic wagering game, the player is given the option of either playing the bonus game or auctioning it away. An auctions button 406 allows the player to turn on the auctions option preparatory to auctioning off the bonus game.

Figure 5:
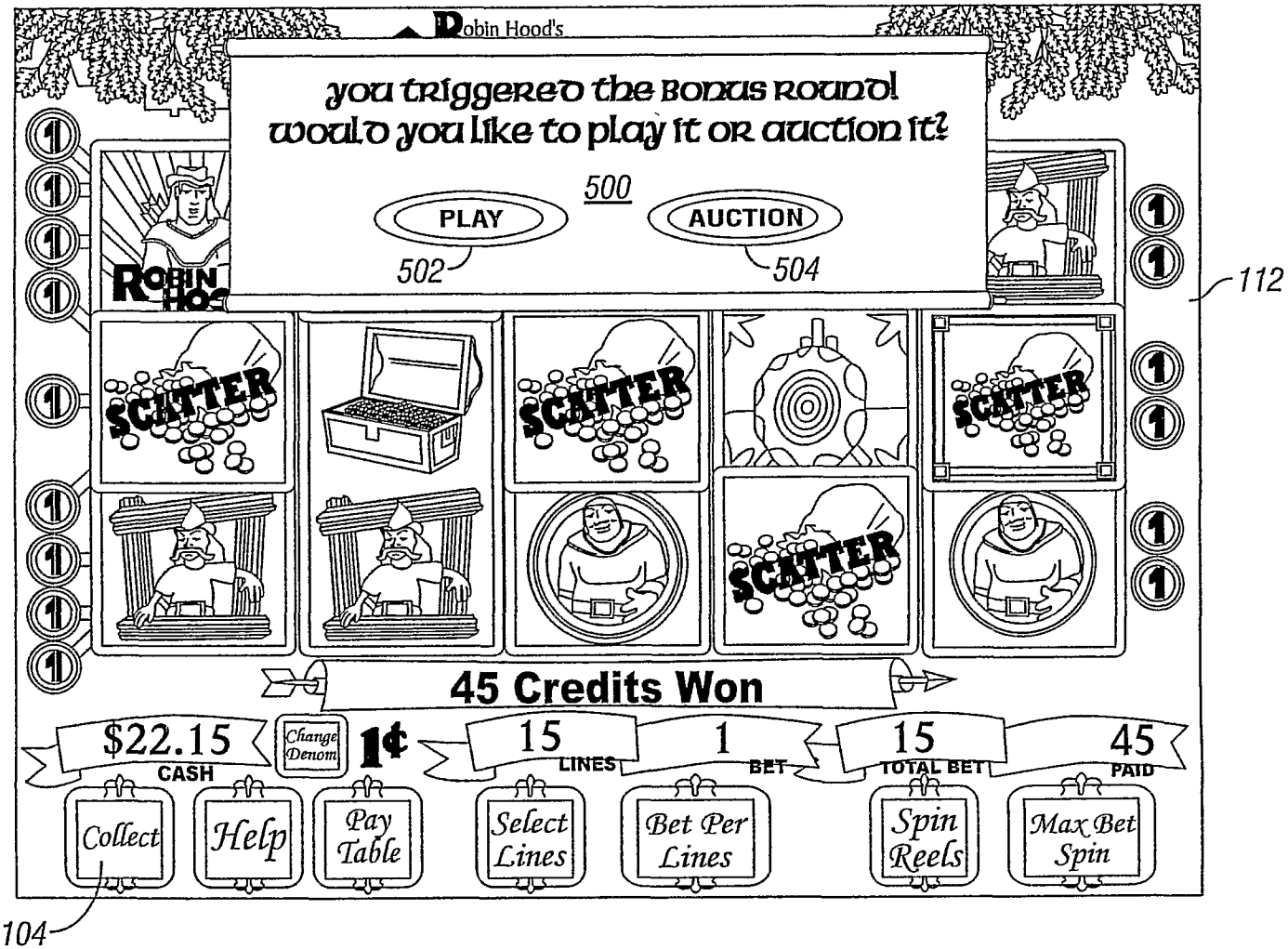
FIG. 5 illustrates an exemplary bonus game transfer screen that may appear on a wagering game terminal of FIG. 1.

FIG. 5 illustrates an exemplary auction screen 500 that may be displayed on the main display 112 (or the secondary display 114) of the wagering game terminal 100 when a bonus game is won. As can be seen, the auction screen 500 includes a play button 502 that allows the player to play the bonus game and an auction button 504 that allows the player to auction off the bonus game. If the player selects the play button 502, then the bonus game is played in the usual manner.

Figure 6:
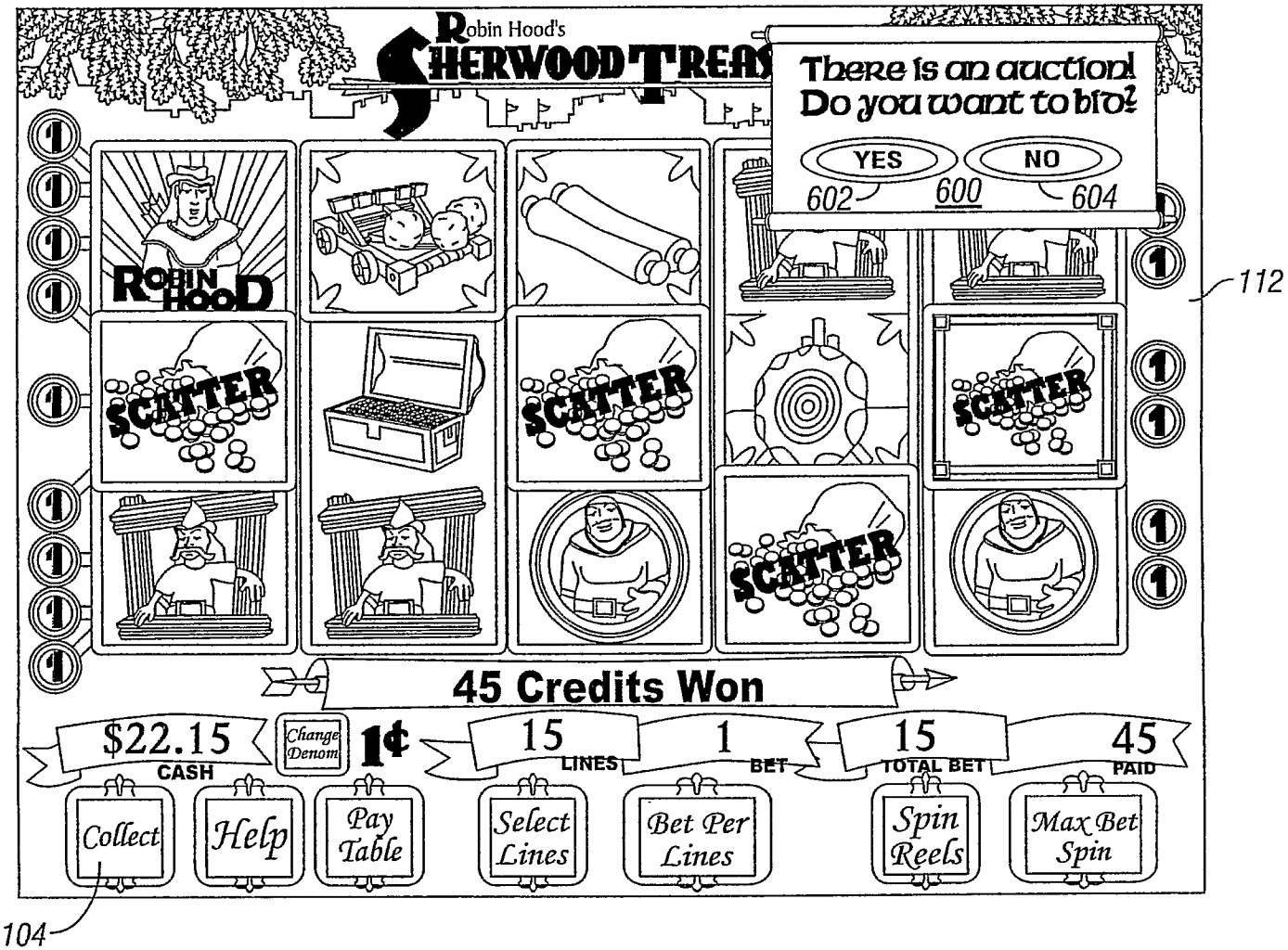
FIGS. 6-8 illustrate exemplary bonus game transfer screens that may appear on other wagering game terminals that are connected to the wagering game terminal of to FIG. 1.

However, if the player selects the auction button 504, the wagering game terminal 100*a* or 100*b* sends a message to the server 304 notifying the server 304 that a bonus game is available for auction. The server 304 thereafter sends a message to the other wagering game terminals 100*a* and 100*b* on the network 212 notifying them of the auction. An example of such a notification is shown in FIG. 6, where an auction notification screen 600 is displayed on the main display 112 (or the secondary display 114) of the other network wagering game terminals currently being played. The auction notification screen 600 provides the players at the other network wagering game terminals the option to participate in the auction (Yes button 602) or to decline the auction (No button 604).

Figure 7:
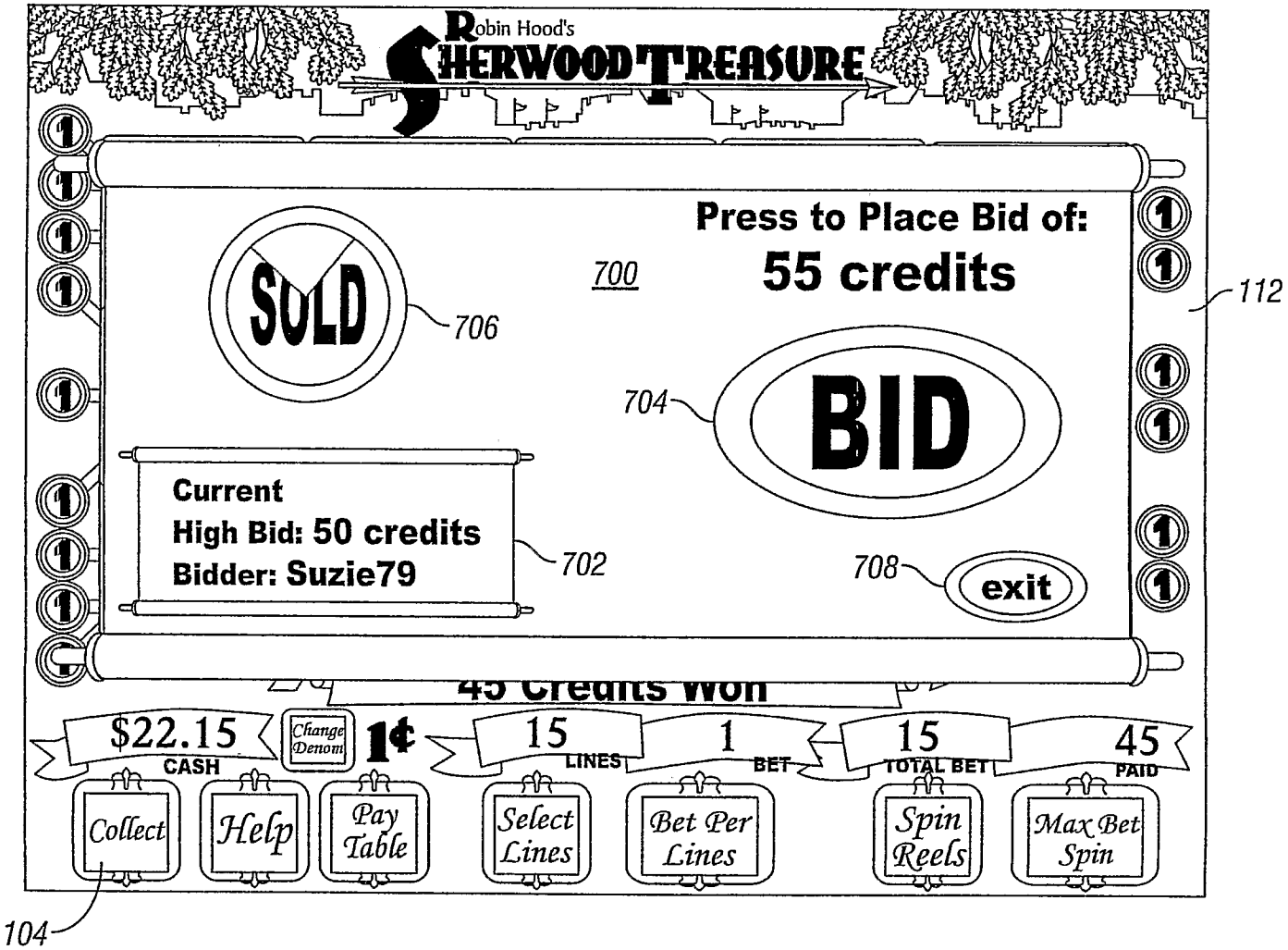

If the players at the other network wagering game terminals choose to participate in the auction (i.e., by selecting the Yes button 602), then as seen in FIG. 7, an auction screen 700 for conducting the auction will appear on their main display 112 (or their secondary display 114). The auction screen 700 may show a variety of information, including an information area 702 that displays the current winning bid and the on-line identifier of the player who submitted the current bid. Also present is a bid button 704 for allowing the participating player to submit a bid. In some embodiments, the next bid may be an automatically generated amount in a manner well-known to those having ordinary skill in the art. A timer 706 displays the time remaining on the auction, which time may be set either automatically by the wagering game terminal or manually by the player. An exit button 708 allows the player to exit the auction at any time.

Figure 8:
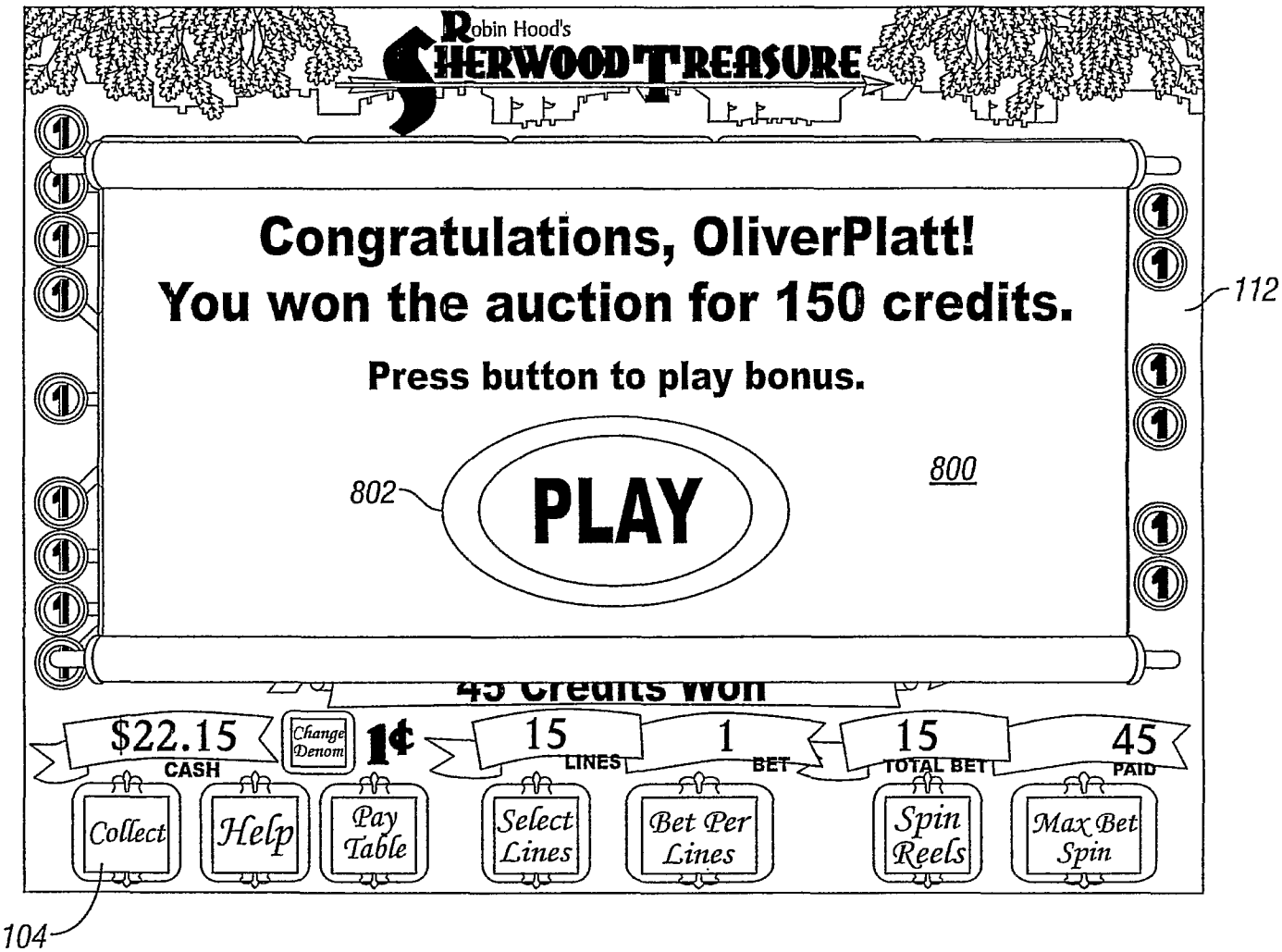

Once the timer 706 expires, the auction is closed and the player with the highest bid wins the bonus game. At this point, the server 304 instructs or otherwise causes the wagering game terminal of the winning player to deduct the appropriate amount of credits from the winning player's account and then initiate the bonus game. This may be manifested by a congratulatory screen 800, shown in FIG. 8, that displays the winning auction amount to be deducted as well as a play button 802 that the player may select to begin playing the bonus game. In some embodiment, the player with the winning bid may also be given the option to turn around and transfer (e.g., via another auction) the bonus game he just won.

In some embodiments, if the winning player happens to be in the middle of his own bonus game when the auction is won, then his wagering game terminal may pause the in-session bonus game in order to allow that player to play the newly won bonus game. At the conclusion of the newly won bonus game, the wagering game terminal continues the in-progress bonus game.

Figure 9:
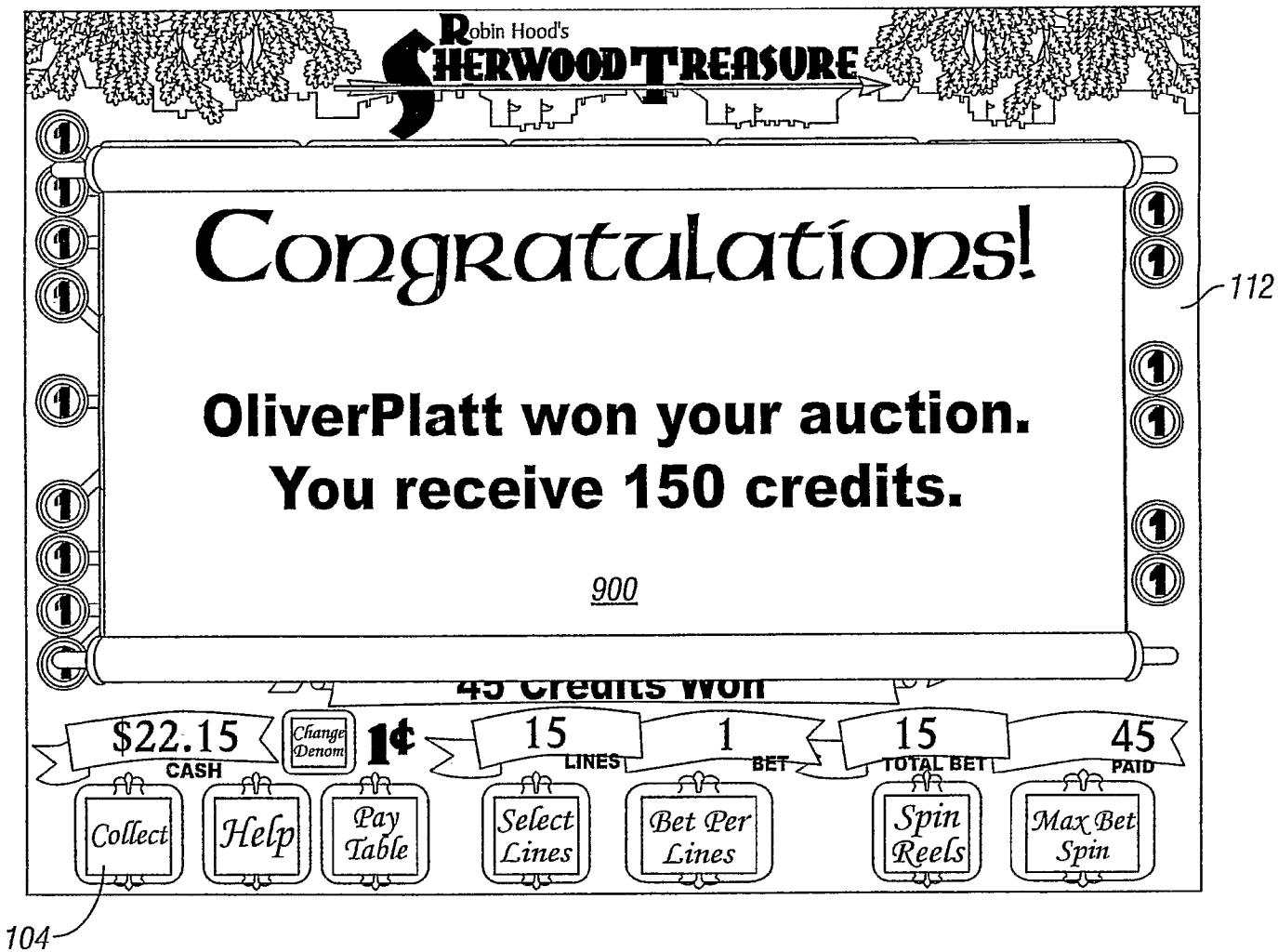
FIG. 9 illustrates an exemplary confirmation screen that may appear on the wagering game terminal of FIG. 1 after the bonus game has been transferred.

At the other end, the server 304 instructs or otherwise causes the wagering game terminal of the player who originally won the bonus game to terminate the bonus game and to credit the player's account with an appropriate number of credits. A congratulatory screen 900, shown in FIG. 9, is displayed on the main display 112 (or the secondary display 114) of the player who originally won the bonus game to confirm the amount of credits. Such an arrangement allows the player to obtain monetary value in exchange for the bonus game in the event he does not wish to play or does not have the time to play the bonus game.

In some embodiments, rather than routing communications through the server 304, it is possible for the wagering game terminals 100*a* and 100*b* on the network 212 to communicate directly with one another. In these embodiments, auction notifications and other types of game asset transfer notifications may be sent directly from one wagering game terminal to another. A separate, stand-alone software application running on each wagering game terminal may then be used to manage the auction bidding process, credit allocation, and so on for each wagering game terminal 100*a* and 100*b*.

Figure 4:
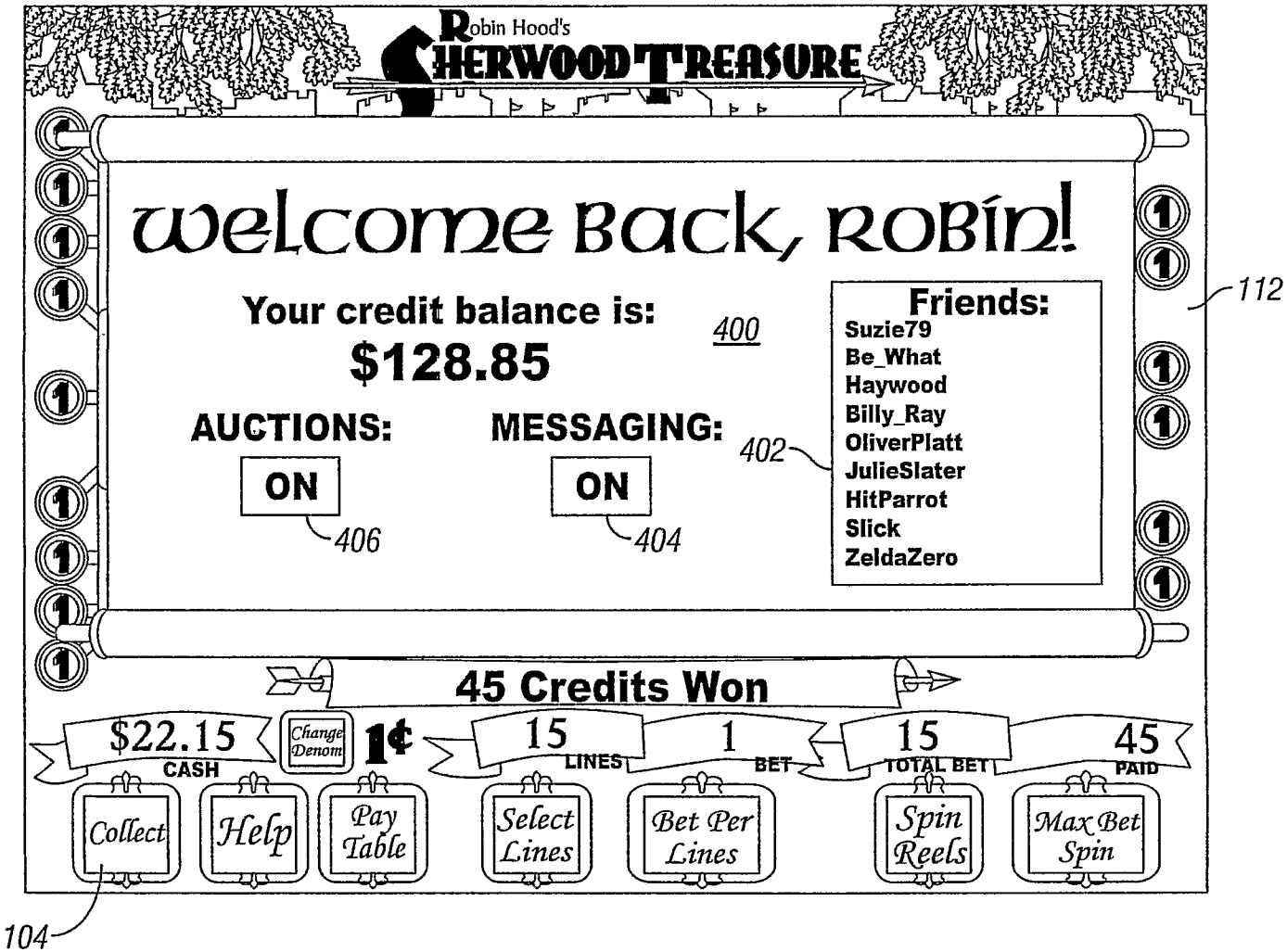
FIG. 4 illustrates an exemplary greeting screen that may appear on the wagering game terminal of FIG. 1.

In some embodiments, instead of auctioning off the bonus game, the player who originally won the bonus game may choose to give the game away, for example, to someone on his friends list 402 (FIG. 4). The player may arrange to give the bonus game away by sending an electronic message to the person on the friends list 402 notifying that person of the gift. Alternatively, instead of giving it away or auctioning it off, the player may choose to trade the bonus game with another person on the friends list 402, either for monetary value (e.g., credits) or for another bonus game or other game assets.

If the player does choose to auction away the bonus game, he may set a minimum monetary amount for the auction. It is also possible to limit the auction participants to only certain people on the friends list 402 (e.g., a private auction) instead of opening the auction to everyone on the network. Other techniques for transferring the bonus game or any other game assets are also within the scope of the invention. For example, the player who originally accrued the game asset may auction the ticket for the game asset via an Internet-based auction service, such as eBay™. The player may also sell it to a retailer for purchase by a third party, or consign it to a seller who deals in such game assets. Where the game assets are stored electronically, for example, as a text, XML, or other suitable file format, the game assets may be downloaded from an on-line database, or sent as an attachment to an electronic message.

In all transfers, it is not necessary for the transferring player to always be present at the wagering game terminal. The transferring player may simply set the transfer criteria (e.g., duration, minimum amount, etc.), then go away and come back at a later time to see the results of the transfer. Nor does the receiving player have to to be at the wagering game terminal for similar reasons, and especially where the transfer is conducted off-line.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A wagering game terminal with game asset transfer capability, comprising:

a display configured to display a randomly selected outcome from a wagering game, said randomly selected outcome being selected from a plurality of outcomes in response to receiving a wager input, said plurality of outcomes including at least one special event outcome; and a network interface unit for connecting said wagering game terminal to a network of wagering game terminals;

wherein, in response to said randomly selected outcome being said at least one special event outcome, said wagering game terminal allowing a player to select to play a bonus game resulting from said at least one special event outcome, store said bonus game for later restoration by said player in a later gaming session on a different wagering game terminal connected to said network of wagering game terminals, or transfer said bonus game to another wagering game terminal associated with another player and connected to said network of wagering game terminals;

wherein said transfer of said bonus game includes an auction of said bonus game in which players at several wagering game terminals connected to said network of wagering game terminals may participate;

wherein said wagering game terminal further allows said player to both specify a minimum monetary amount for said auction of said bonus game and select which players may participate in said auction from a predefined list of players;

wherein said wagering game terminal allows said player to pause play of said bonus game in response to said wagering game terminal receiving a second bonus game, won via an auction and transferred to said wagering game terminal, and said wagering game terminal allows said player to resume said play of said bonus game in response to play of said second bonus game being concluded.

2. The wagering game terminal according to claim 1, wherein said auction is only open for a predetermined amount of time.

3. The wagering game terminal according to claim 1, wherein said wagering game terminal is further configured to restore said bonus game stored by said player in a previous gaming session.

4. A method of operating a wagering game terminal having a game-asset transfer capability, said wagering game terminal connected to a network of wagering game terminals, comprising:

displaying a randomly selected outcome from a wagering game on said wagering game terminal, said randomly selected outcome being selected from a plurality of outcomes in response to receiving a wager input, said plurality of outcomes including at least one special event outcome;

in response to said randomly selected outcome being said at least one special event outcome, allowing a player to select to play a bonus game resulting from said at least one special event outcome, store said bonus game for later restoration by said player in a later gaming session on a different wagering game terminal connected to said network of wagering game terminals, or transfer said bonus game to another wagering game terminal associated with another player and connected to said network of wagering game terminals, said step of allowing said player to transfer said bonus game includes allowing said player to auction said bonus game to players at several wagering game terminals connected to said network of wagering game terminals;

allowing said player to both specify a minimum monetary amount for said auction of said bonus game and select which players may participate in said auction from a predefined list of players;

conducting a second bonus game on said wagering game terminal in response to another randomly selected outcome being the at least one special event outcome;

while conducting said second bonus game, receiving a third bonus game, won via an auction, from another wagering game terminal connected to said network;

pausing said conducting of said second bonus game on said wagering game terminal;

while pausing said second bonus game, conducting said third bonus game on said wagering game terminal; and after concluding said third bonus game, resuming said conducting of said second bonus game on said wagering game terminal.

5. The method according to claim 4, further comprising limiting an amount of time said auction is open.

6. The method according to claim 4, further comprising restoring said bonus game stored by said player in a previous gaming session.

7. The method according to claim 6, further comprising identifying said player using a biometric identification device configured to obtain biometric information from said player.

8. The wagering game terminal according to claim 7, wherein said biometric identification device is a voice recognition system.

9. A system for reallocating game assets between wagering game terminals, comprising:

a first wagering game terminal having a first bonus game available to be transferred via an auction, wherein said first wagering game terminal further allows a first player to specify a minimum monetary amount for said auction of said first bonus game; and a second wagering game terminal connected to said first wagering game terminal over a network, wherein said second wagering game terminal participating in said auction;

wherein said first wagering game terminal is configured to transfer said first bonus game to said second terminal upon occurrence of said second wagering game terminal winning said auction, said auction includes said first wagering game terminal and said second wagering game terminal being played concurrently;

wherein said second wagering game terminal is configured to pause a second bonus game being conducted on said second wagering game terminal to allow a second player to play said first bonus game on said second wagering game terminal and then resume said second bonus game after said first bonus game is concluded.

10. The system according to claim 9, further comprising a server connected to said first wagering game terminal and to said second wagering game terminal, said server configured to control communication between said first wagering game terminal and said second wagering game terminal.

11. The system according to claim 9, wherein said first bonus game available to be transferred on said first wagering game terminal was restored to said first wagering game terminal from a previous game session.

* * * * *

UNITED STATES PATENT AND TRADEMARK OFFICE

CERTIFICATE OF CORRECTION

PATENT NO. : 8,425,323 B2
APPLICATION NO. : 11/988853
DATED : April 23, 2013
INVENTOR(S) : Fiden et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1692 days.

Signed and Sealed this
Eighth Day of September, 2015

Michelle K. Lee

Michelle K. Lee
*Director of the United States Patent and Trademark Office*